US007467634B2

(12) United States Patent
Jessup et al.

(10) Patent No.: US 7,467,634 B2
(45) Date of Patent: Dec. 23, 2008

(54) NO CONTACT SPRAY APPARATUS CLEANING DEVICE

(76) Inventors: Philip Jessup, 321 Ayldier Street, Peterborough, Ontario (CA) K9H-3V7; James Doyle, 662 Trailview Drive, Peterborough, Ontario (CA) K97-8P1

( * ) Notice: Subject to any disclaimer, the term of this patent is extended or adjusted under 35 U.S.C. 154(b) by 534 days.

(21) Appl. No.: 10/538,424

(22) PCT Filed: Feb. 21, 2003

(86) PCT No.: PCT/CA03/00239

§ 371 (c)(1),
(2), (4) Date: Jun. 10, 2005

(87) PCT Pub. No.: WO2004/073881

PCT Pub. Date: Sep. 2, 2004

(65) Prior Publication Data

US 2006/0048803 A1 Mar. 9, 2006

(51) Int. Cl.
*B08B 3/00* (2006.01)

(52) U.S. Cl. ..... 134/102.1; 134/21; 134/95.2; 134/95.3; 134/102.2; 134/102.3; 134/104.1; 134/150; 134/166 R

(58) Field of Classification Search ..... 134/94.1, 134/21, 95.2, 95.3, 102.1, 102.2, 102.3, 104.1, 134/104.2, 150, 151, 166 R
See application file for complete search history.

(56) References Cited

U.S. PATENT DOCUMENTS

| | | | | |
|---|---|---|---|---|
| 3,191,814 | A * | 6/1965 | Corsette et al. | 222/384 |
| 4,823,820 | A * | 4/1989 | Larson et al. | 134/109 |
| 4,827,955 | A * | 5/1989 | Stern | 134/99.1 |
| 4,923,522 | A * | 5/1990 | Sowers | 134/22.1 |
| 4,977,911 | A * | 12/1990 | Vetter et al. | 134/34 |
| 5,174,317 | A * | 12/1992 | Robb et al. | 134/166 C |
| 6,520,190 | B2 * | 2/2003 | Thompson et al. | 134/22.18 |

FOREIGN PATENT DOCUMENTS

| | | |
|---|---|---|
| DE | 10110098 | 9/2002 |
| JP | 59127671 | 7/1984 |
| JP | 07284702 | 10/1995 |

* cited by examiner

*Primary Examiner*—Michael Barr
*Assistant Examiner*—Rita R Patel
(74) *Attorney, Agent, or Firm*—Gifford, Krass, Sprinkle, Anderson & Citkowski, P.C.

(57) ABSTRACT

The invention is an automatic no contact machine for cleaning and drying tips, air caps, retainers and cups on spray apparatus when changing liquid or when the apparatus will be idle, or to remove build up of paint on applicators that cause spits and drips on surfaces and electrostatic arcing to spray apparatus while containing and recovering cleaning effluents to an environmental standard.

7 Claims, 6 Drawing Sheets

NO CONTACT SPRAY APPARATUS CLEANING DEVICE

BACKGROUND OF THE INVENTION

Field of the Invention

The invention pertains generally to an industrial machine. More specifically, the invention relates to a no contract spray apparatus cleaning device for the robotic spray paint line industry, utilizing solvent recovery systems. The invention includes a unique no contact sealing system, one solvent line with a spray block head or plurality of spray heads and check valves and one air line with a velocity ring contained in a unique body and a second external air line connected to an evaporator drying system, connected to the body of the cleaning device which is connected to a solvent recovery system.

The current method of cleaning spray apparatus is largely to manually clean the spray tip. Some users insert and mechanically seal a spray gun tip into an opening in a cleaning tank that is connected to a solvent recovery system. When mechanically sealed in the solvent recovery system, to prevent air born effluent, the plumbing lines of the spray equipment are flushed with solvent or recharged, and the sealed tip of the spray apparatus is cleaned and dried using one solvent and one air supply line contained within the cleaning tank.

The invention possesses numerous benefits and advantages over known spray apparatus cleaning devices. In particular, the invention utilizes the principals of fluid dynamics to seal the spray apparatus tip in the system without physical contact. This no contact seal greatly reduces the cost of manufacturing the invention, and damage to the spray apparatus tip caused by conventional contact sealing.

The invention eliminates gun spits and drips related to air caps on automatic robotic paint guns. Moreover, the invention has no high speed moving parts, which reduces maintenance and the possibility of fire related to rotary friction or build up of static electricity. Because of its flexibility, effectiveness and simplicity in use, installation, and manufacture, the invention realizes a reduction in costs and in the costs of ongoing maintenance, while maintaining an environmental standard.

A practical example of the flexibility possessed by the invention resides in its ability to clean air caps as well as cap mounting rings. As well as cups on rotary applicators that have self-internal cleaning. Furthermore the invention is compatible with automatic colour changes, as well as mid colour run cap soaks. The invention further improves electrostatic transfer by cleaning spray apparatus external parts to prevent current tracking when using electrostatic painting techniques.

In addition to the foregoing attributes, the invention possesses numerous other financial and environmental benefits over conventional devices. The invention's external air dry system is a benefit by eliminating the use of air knifes that plug up while sweeping the face of the air cap to dry the paint gun and eliminate solvent drips that affect production. The advantage of a check valve in the spray head keeps the solvent line charged, so minimal solvent and time is used when cleaning. Standard cleaning time is 0.5-1 second, thereby speeding up cleaning and increasing productivity.

It can thus be seen that the present invention provides a novel machine, which successfully cleans and dries spraying apparatus.

SUMMARY OF DRAWINGS

In the drawings, which form a part of this specification.

DESCRIPTION OF THE PREFERRED EMBODIMENT

Figure 1:
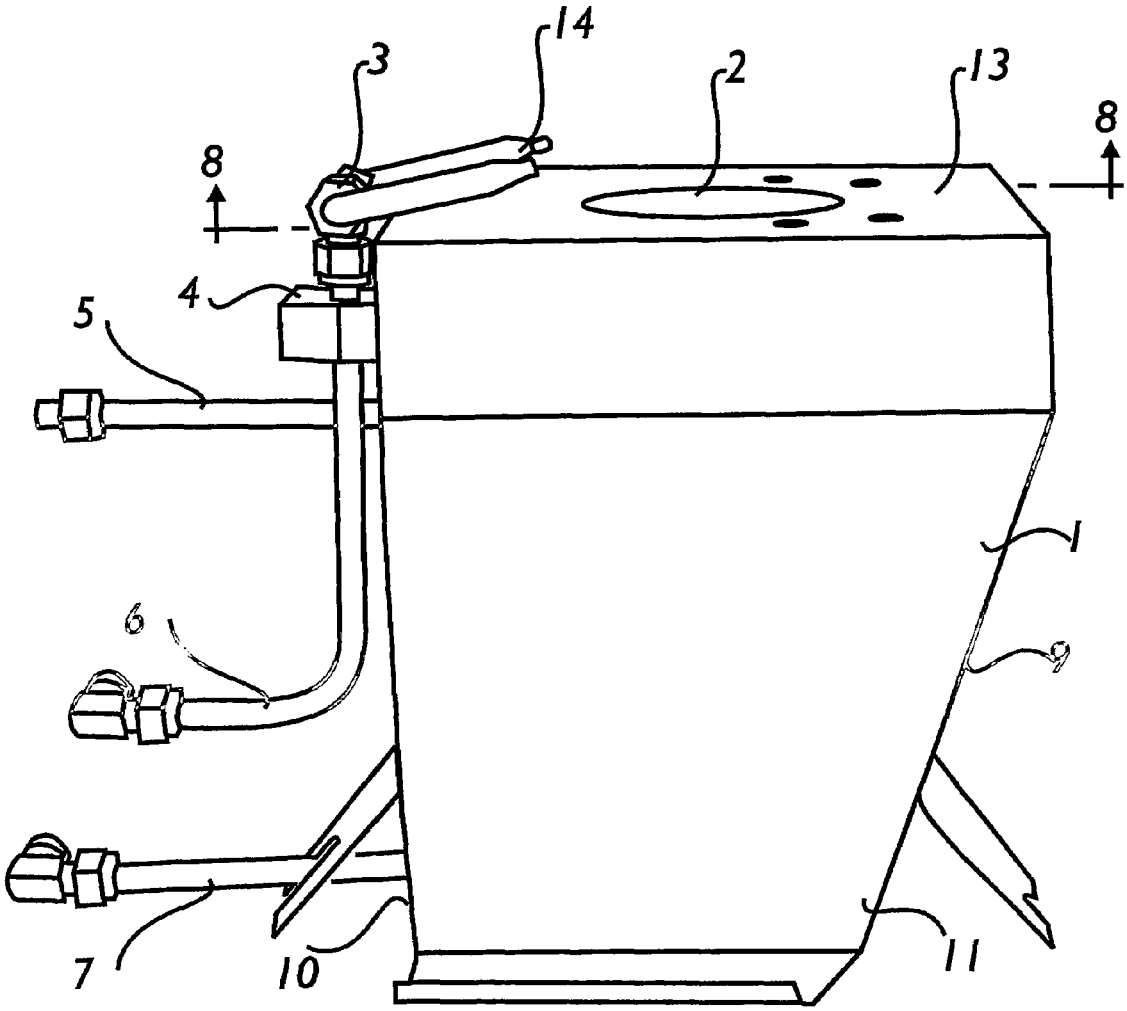
FIG. 1 is a semi-diagrammatic view of the automatic spray apparatus cleaning device according to one embodiment of the invention showing the automatic spray apparatus cleaning device.
Figure 2:
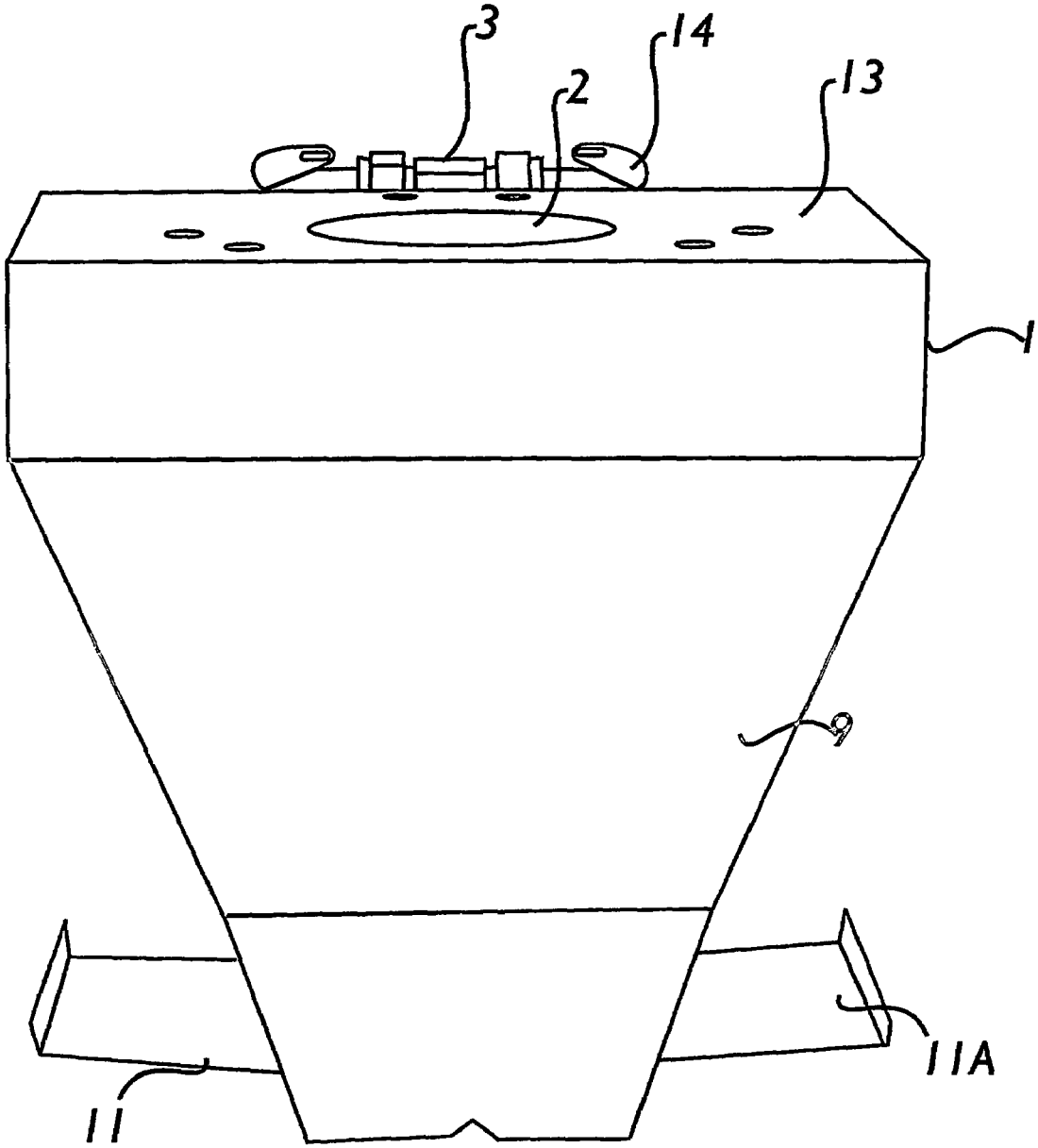
FIG. 2 is a front semi-diagrammatic view of the device.
Figure 3:
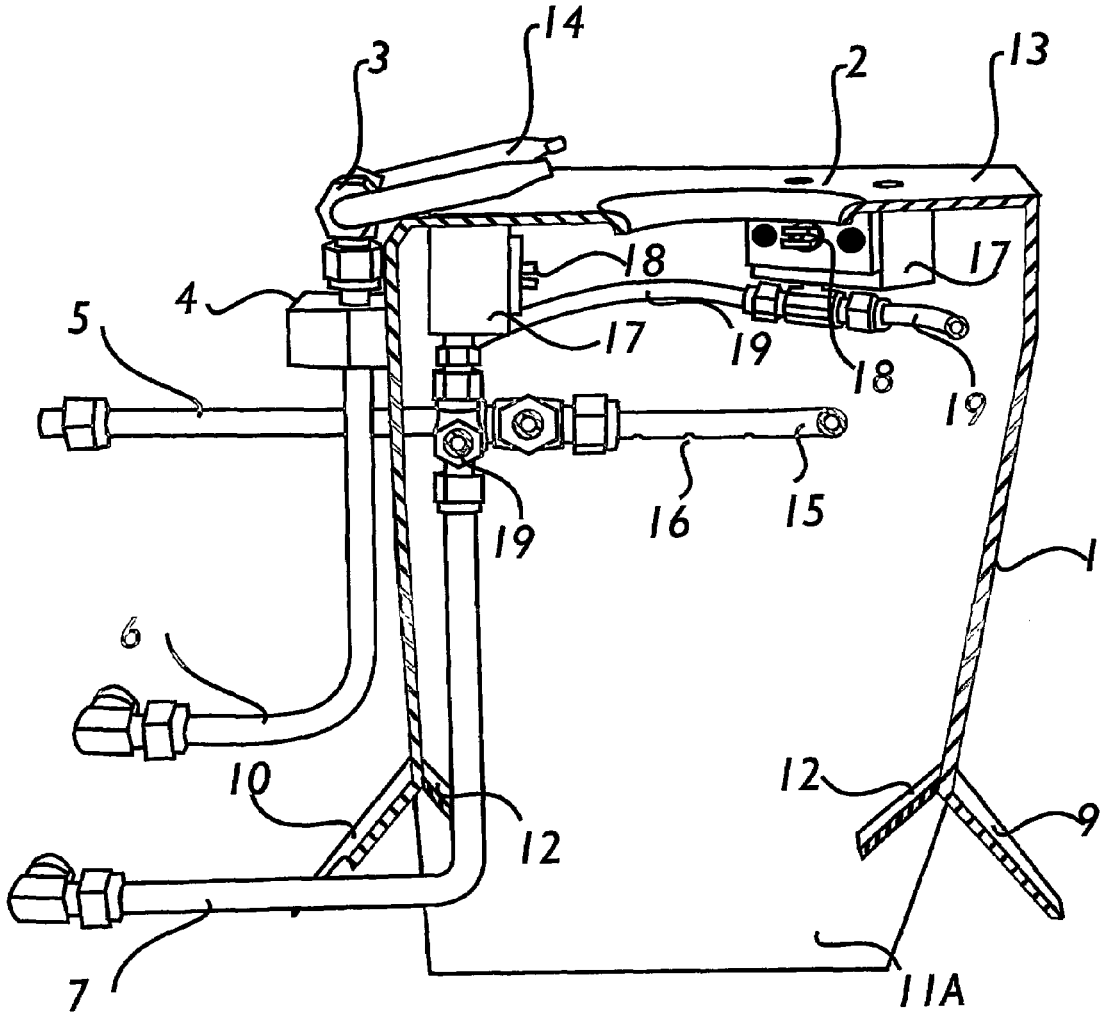
FIG. 3 is a transverse cross-sectional view, taken generally on line 8-8, FIG. 1, with some parts deleted for clarity of illustration.

With reference to the drawings and in particular, with reference to FIGS. 1-3, the no contact spray apparatus cleaning device comprises a body, indicated generally at 1, fabricated as an integral fabrication of an rigid material, preferably a metal. The body is defined by a front wall 9, a rear wall 10, a pair of side walls 11, a pair of solvent strippers 12, and a top wall 13. A no contact seal opening 2 is formed in the top wall.

Attached through the rear wall 10 and extending into the body is the air velocity ring supply line 5 and solvent spray head block supply line 7.

The mounting block 4 attached to the exterior of the rear wall of the body holds the evaporator assembly line 6 that delivers air to the sweep evaporator head 3.

Figure 4:
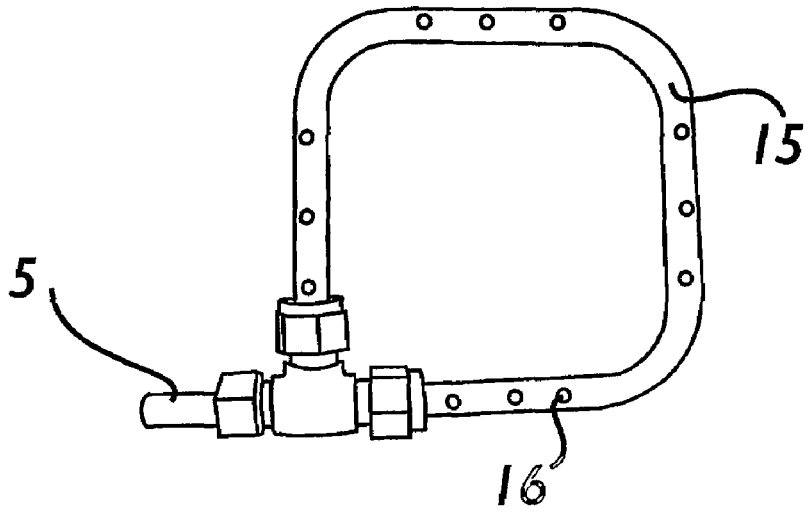
FIG. 4 is a semi-diagrammatic view of the velocity ring assembly viewed from the opening in the bottom of the device.
Figure 5:
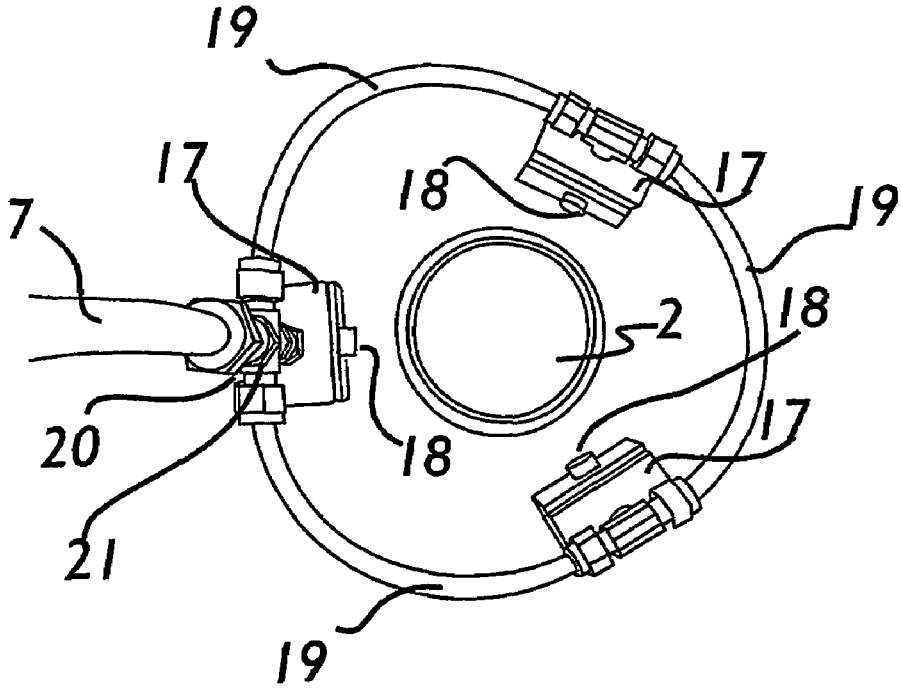
FIG. 5 is a semi-diagrammatic view of the spray block assembly viewed from the opening in the bottom of the device.

With reference to the drawings and in particular, with reference to FIGS. 3-5 contained with in the body of the device are the velocity ring 15, velocity port 16, the spray head block 17, supply lines 19 and the spray nozzle 18.

Figure 6:
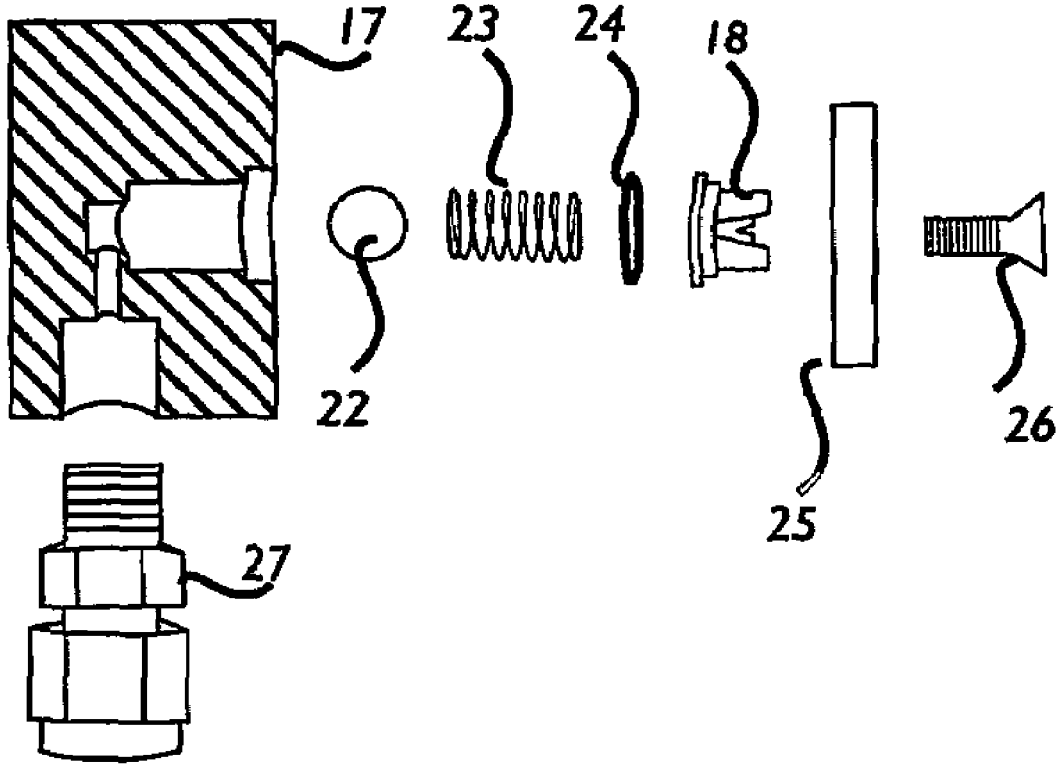
FIG. 6 is an exploded view of the spray block head assembly.
Figure 7:
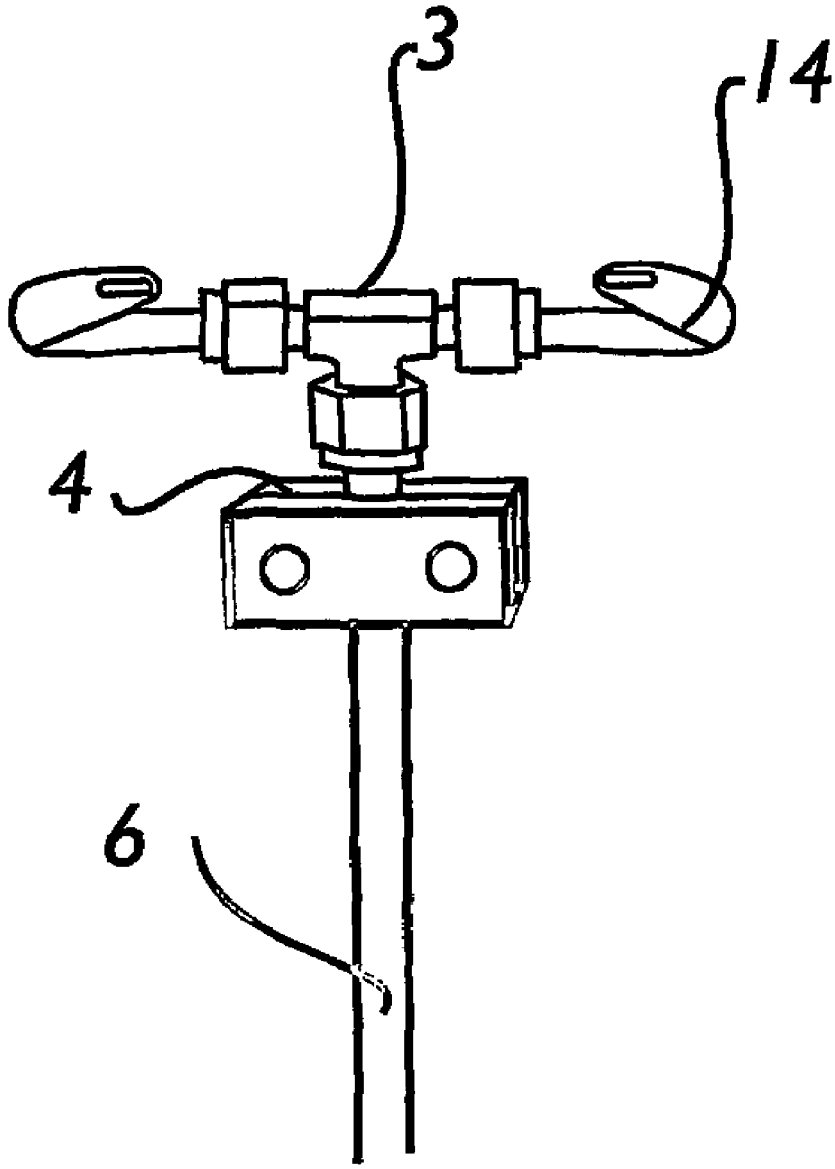
FIG. 7 is a semi-diagrammatic view of the evaporator assembly.

With reference to the drawings FIG. 6, the spray head assembly comprises, the block, a ball 22, a spring 23, an o-ring 24, a nozzle 18, a retainer 25, fastener 26 and fitting 27.

The spray gun apparatus is programmed to be inserted into the no contact seal opening at which point the velocity ring is turned on to create the low pressure area. When the spray gun tip reaches a pre-determined depth, solvent is sprayed through the spray head assembly onto the spray gun tip while the tip is being moved up to a pre-determined dwell position, at which time the solvent spray head is shut off and the evaporator horn assembly is energized. The spray gun tip is then withdrawn from the no contact sealing area in a rotational motion which allows the evaporator horn assembly to dry the spray gun tip with compressed air shaped to be evacuated into the formed opening. At the end of the rotational motion the evaporator horn assembly is shut off and the spray gun tip returns to its original program.

The expelled solvent is channeled by the solvent strippers, from the body, to a solvent recovery system.

The embodiments of the invention in which an exclusive property or privilege is claimed are defined as follows:

1. A non-contact device for cleaning and drying a spray gun having a spray tip, said device comprising:

a housing having a top wall and an opening in said top wall dimensioned to receive the spray tip therein, a source of pressurized gas, a velocity ring contained in said housing below and in alignment with said housing top wall opening, said source of pressurized gas being connected to said velocity ring, said velocity ring having at least one gas port directed away from said opening so that gas flow from said source of pressurized gas through said velocity ring and said port flows away from said housing top wall opening, a solvent spray head block mounted to said housing, a source of solvent fluidly connected to said solvent spray head block, wherein said solvent spray head block is positioned to direct a spray of solvent from said source of solvent on the spray tip of the spray gun when is positioned in said housing to thereby clean the spray gun spray tip, and wherein said housing has at least one exhaust opening below said velocity ring so that air flow through said velocity ring passes out through said at least one exhaust opening.

2. The invention as defined in claim 1 and comprising a sweep evacuator head having a gas outlet positioned above and adjacent said housing opening, said source of pressurized gas being fluidly connected to said sweep evacuator head after the spray gun spray tip has been cleaned by said solvent spray head block.

3. The invention as defined in claim 1 wherein said source of pressurized gas comprises a source of pressurized air.

4. The invention as defined in claim 1 wherein said at least one port in said velocity ring comprises a plurality of spaced ports in said velocity ring.

5. The invention as defined in claim 1 wherein said solvent spray head block comprises at least two solvent ports, said solvent ports being spaced apart from each other and positioned around said housing top wail opening.

6. The invention as defined in claim 5 wherein said solvent ports are positioned below said housing top wall.

7. The invention as defined in claim 1 and comprising a bail check valve connected in series with said solvent head spray block.

* * * * *